US010060629B2

(12) United States Patent
Kim et al.

(10) Patent No.: US 10,060,629 B2
(45) Date of Patent: Aug. 28, 2018

(54) ANGLED RADIAL FUEL/AIR DELIVERY SYSTEM FOR COMBUSTOR

(71) Applicant: United Technologies Corporation, Hartford, CT (US)

(72) Inventors: Wookyung Kim, Glastonbury, CT (US); Zhongtao Dai, Glastonbury, CT (US); Kristin Kopp-Vaughan, East Hartford, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 459 days.

(21) Appl. No.: 14/627,709

(22) Filed: Feb. 20, 2015

(65) Prior Publication Data

US 2016/0245523 A1 Aug. 25, 2016

(51) Int. Cl.

| | |
|---|---|
| ***F23R 3/34*** | (2006.01) |
| ***F23R 3/28*** | (2006.01) |
| ***F23R 3/50*** | (2006.01) |

(52) U.S. Cl.

CPC ..... *F23R 3/286* (2013.01); *F23R 3/28* (2013.01); *F23R 3/34* (2013.01); *F23R 3/346* (2013.01); *F23R 3/50* (2013.01); *F23R 3/283* (2013.01)

(58) Field of Classification Search

CPC .. F23R 3/28; F23R 3/283; F23R 3/286; F23R 3/34; F23R 3/346

See application file for complete search history.

(56) References Cited

U.S. PATENT DOCUMENTS

| | | | | | |
|---|---|---|---|---|---|
| 1,793,640 | A * | 2/1931 | Schilling | F02C 5/12 | 60/39.79 |
| 2,999,359 | A * | 9/1961 | Murray | F23R 3/04 | 60/733 |
| 3,872,664 | A * | 3/1975 | Lohmann | F23R 3/14 | 431/9 |
| 3,977,186 | A * | 8/1976 | Arvin | F23C 7/02 | 431/352 |
| 4,045,956 | A * | 9/1977 | Markowski | F23R 3/30 | 431/352 |
| 4,192,139 | A * | 3/1980 | Buchheim | F23R 3/346 | 60/39.826 |

(Continued)

FOREIGN PATENT DOCUMENTS

| | | |
|---|---|---|
| GB | 834975 | 5/1960 |
| WO | 2014201135 | 12/2014 |

OTHER PUBLICATIONS

Extended European Search Report dated May 18, 2016 in European Application No. 15201373.6.

*Primary Examiner* — Lorne Meade
*Assistant Examiner* — Eric Linderman
(74) *Attorney, Agent, or Firm* — Snell & Wilmer, L.L.P.

(57) ABSTRACT

A combustor is provided. The combustor may comprise an axial fuel delivery system, and a radial fuel delivery system aft of the axial fuel delivery system. The radial fuel delivery system may be configured to direct fuel at least partially towards the axial fuel delivery system. A radial fuel delivery system is also provided. The system may comprise a combustor including a combustor liner, a mixer coupled to the combustor liner, and a nozzle disposed within the mixer, wherein the mixer and the nozzle are configured to direct fuel in a direction at least partially forward.

14 Claims, 4 Drawing Sheets

(56) References Cited

U.S. PATENT DOCUMENTS 4,265,615 A * 5/1981 Lohmann ..... F23R 3/346 431/158
4,420,929 A * 12/1983 Jorgensen ..... B60C 9/08 60/733
5,205,117 A * 4/1993 Shekleton ..... F23R 3/002 60/778
5,259,184 A * 11/1993 Borkowicz ..... F23D 14/00 60/39.55
5,473,881 A * 12/1995 Kramnik ..... F23R 3/34 60/737
5,487,275 A * 1/1996 Borkowicz ..... F23R 3/346 60/747
5,575,146 A * 11/1996 Borkowicz ..... F23R 3/346 60/776
5,575,154 A * 11/1996 Loprinzo ..... F23R 3/045 60/746
5,647,215 A * 7/1997 Sharifi ..... F23D 17/002 239/431
5,865,030 A * 2/1999 Matsuhama ..... F02C 7/224 60/267
5,924,276 A * 7/1999 Mowill ..... F01D 17/145 60/39.23
6,286,298 B1 * 9/2001 Burrus ..... F23R 3/50 60/732
6,298,667 B1 * 10/2001 Glynn ..... F23R 3/002 29/889.2
6,311,471 B1 * 11/2001 Waldherr ..... F02C 3/30 60/39.55
6,530,223 B1 * 3/2003 Dodds ..... F23R 3/343 60/39.826
6,536,216 B2 * 3/2003 Halila ..... F01D 5/08 60/737
6,868,676 B1 * 3/2005 Haynes ..... F02C 3/14 60/740
6,925,809 B2 * 8/2005 Mowill ..... F23R 3/26 431/186
7,093,441 B2 * 8/2006 Burd ..... F23R 3/42 60/752
7,665,309 B2 * 2/2010 Parker ..... F23R 3/28 60/740
7,886,545 B2 * 2/2011 Lacy ..... F23R 3/286 60/39.37
7,954,325 B2 * 6/2011 Burd ..... F23R 3/04 60/752
8,275,533 B2 * 9/2012 Davis, Jr. ..... F02C 7/22 60/39.5
8,387,398 B2 * 3/2013 Martin ..... F01D 9/023 60/733
8,479,521 B2 * 7/2013 Hoke ..... F23R 3/06 60/746
9,068,748 B2 * 6/2015 Hoke ..... F23R 3/06
9,388,987 B2 * 7/2016 Valeev ..... F23L 7/00
9,400,113 B2 * 7/2016 Ogata ..... F23R 3/34
9,638,423 B2 * 5/2017 Ogata ..... F23R 3/34
2004/0020211 A1 * 2/2004 Kendrick ..... F01D 1/026 60/750
2007/0151250 A1 * 7/2007 Haynes ..... F23R 3/02 60/772
2008/0264033 A1 * 10/2008 Lacy ..... F23R 3/286 60/39.49
2009/0084082 A1 * 4/2009 Martin ..... F01D 9/023 60/39.281
2010/0162710 A1 * 7/2010 Senior ..... F23R 3/286 60/737
2010/0170252 A1 * 7/2010 Venkataraman ..... F02C 3/20 60/742
2010/0170254 A1 * 7/2010 Venkataraman ..... F23R 3/346 60/746
2010/0229557 A1 * 9/2010 Matsumoto ..... F23R 3/34 60/737
2011/0067402 A1 * 3/2011 Wiebe ..... F23R 3/08 60/740
2011/0289929 A1 * 12/2011 Khan ..... F23D 11/24 60/772
2013/0174558 A1 * 7/2013 Stryapunin ..... F23R 3/286 60/734
2013/0318991 A1 * 12/2013 DiCintio ..... F23R 3/34 60/774
2014/0238034 A1 * 8/2014 Slobodyanskiy ..... F23R 3/002 60/772
2014/0301820 A1 * 10/2014 Lohse ..... F02C 7/26 415/1
2015/0110607 A1 * 4/2015 Iizuka ..... F04D 17/10 415/151
2015/0285501 A1 * 10/2015 DiCintio ..... F23R 3/14 60/740
2016/0047317 A1 * 2/2016 Willis ..... F02C 7/22 60/740
2016/0209039 A1 * 7/2016 Cheung ..... F23R 3/286
2016/0245525 A1 * 8/2016 Snyder, III ..... F23R 3/06
2018/0003387 A1 * 1/2018 Cheung ..... F23R 3/34

* cited by examiner

ANGLED RADIAL FUEL/AIR DELIVERY SYSTEM FOR COMBUSTOR

GOVERNMENT LICENSE RIGHTS

This disclosure was made with government support under contract No. NNC13TA45T awarded by National Aeronautics and Space Administration (NASA). The government has certain rights in the disclosure.

FIELD OF INVENTION

The present disclosure relates to combustion systems for gas turbine engines, and, more specifically, to an angled radial fuel/air mixture delivery system for a combustor.

BACKGROUND

Gas turbine engines may comprise a compressor for pressurizing an air supply, a combustor for burning a fuel, and a turbine for converting the energy from combustion into mechanical energy. The combustor may have an inner liner and an outer liner that define a combustion chamber. A fuel injector would typically introduce fuel into the front section of the combustor. As the fuel burns, nitrogen oxide (NOx) and other emissions may be produced. Such emissions are subject to administrative regulation. To reduce NOx emission and improve pattern factor, a fuel staged lean burn combustor may be used. For example, axially staged combustors may include pilot fuel injectors and radial main mixers. The pilot fuel injectors introduce fuel into the front section of the combustor, while the radial main mixers located downstream of the pilot injectors deliver fuel/air mixture radially at an angle into the combustor.

When injected normally into the combustor, the main flame generated by the main radial mixer may have a very long flame length. As a result, the main flame may either extend to the combustor exit or be quenched by the opposite side liner. As shorter combustor lengths typically provide better performance, long flame lengths corresponding to greater combustor lengths may decrease performance. Similarly, quenching the main flame on the opposite side liner may result in a poor burn. Poor mixing will result in poor pattern factor.

SUMMARY

A fuel staged combustor may comprise an axial fuel delivery system, and a radial fuel delivery system aft of the axial fuel delivery system. The radial fuel delivery system may be configured to direct a mixture of fuel and air at least partially towards the axial fuel delivery system.

In various embodiments, the axial fuel delivery system may be configured to deliver fuel in a gas flow path. The radial fuel delivery system may be configured to direct a mixture of fuel and air into the combustor at an angle between 5 degrees and 85 degrees relative to a gas flow path. The radial fuel delivery system may be configured to direct a mixture of fuel and air into the combustor at an angle between 15 degrees and 75 degrees relative to the normal of gas flow path. A liner may have the radial fuel delivery system extending at least partially though the liner. The radial fuel delivery system may comprise a mixer disposed in a cavity defined by a combustor liner. The combustor may comprise a plurality of axial fuel delivery systems with one to three radial fuel delivery systems for each axial fuel delivery system.

A gas turbine engine may comprise a compressor, a combustor aft of the compressor, and an axial fuel delivery system in the combustor. A radial fuel delivery system may be downstream of the axial fuel delivery system in the combustor, and the radial fuel delivery system may be configured to direct fuel at least partially in an upstream direction.

In various embodiments, the axial fuel delivery system may be configured to deliver fuel in a gas flow path. The radial fuel delivery system may be configured to direct fuel into the combustor at an angle between 5 degrees and 85 degrees relative to the gas flow path. The radial fuel delivery system may be configured to direct fuel into the combustor at an angle between 15 degrees and 75 degrees relative to the gas flow path. The combustor may further comprise a liner with the radial fuel delivery system extending at least partially though the liner. The radial fuel delivery system may comprise a mixer disposed in a cavity defined by a combustor liner. The combustor may further comprise a plurality of axial fuel delivery systems with one to three radial fuel delivery systems for each axial fuel delivery system.

A radial fuel delivery system may comprise a combustor including a combustor liner, a mixer coupled to the combustor liner, and a nozzle disposed within the mixer, wherein the mixer and the nozzle are configured to direct fuel at least partially in an upstream direction.

In various embodiments, the mixer and the nozzle are configured to deliver a mixture of fuel and air at a negative angle relative to a gas flow path. The radial fuel delivery system may be configured to direct a mixture of fuel and air into the combustor at an angle between 5 degrees and 85 degrees relative to a gas flow path. The radial fuel delivery system may also be configured to direct a mixture of fuel and air into the combustor at an angle between 15 degrees and 75 degrees relative to the normal of a gas flow path. The mixer may be disposed at least partially through the combustor liner. The mixer may be configured to deliver a mixture of fuel and air mixture at an angle relative to the combustor liner.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the exemplary embodiments of the disclosure, it should be understood that other embodiments may be realized and that logical changes and adaptations in design and construction may be made in accordance with this disclosure and the teachings herein. Thus, the detailed description herein is presented for purposes of illustration only and not limitation. The scope of the disclosure is defined by the appended claims. For example, the steps recited in any of the method or process descriptions may be executed in any order and are not necessarily limited to the order presented.

Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts but not necessarily to denote the same or different materials.

As used herein, "aft" refers to the direction associated with the tail (e.g., the back end) of an aircraft, or generally, to the direction of exhaust of the gas turbine. As used herein, "forward" refers to the direction associated with the nose (e.g., the front end) of an aircraft, or generally, to the direction of flight or motion.

As used herein, "distal" refers to the direction radially outward, or generally, away from the axis of rotation of a turbine engine. As used herein, "proximal" refers to a direction radially inward, or generally, towards the axis of rotation of a turbine engine.

Figure 1:
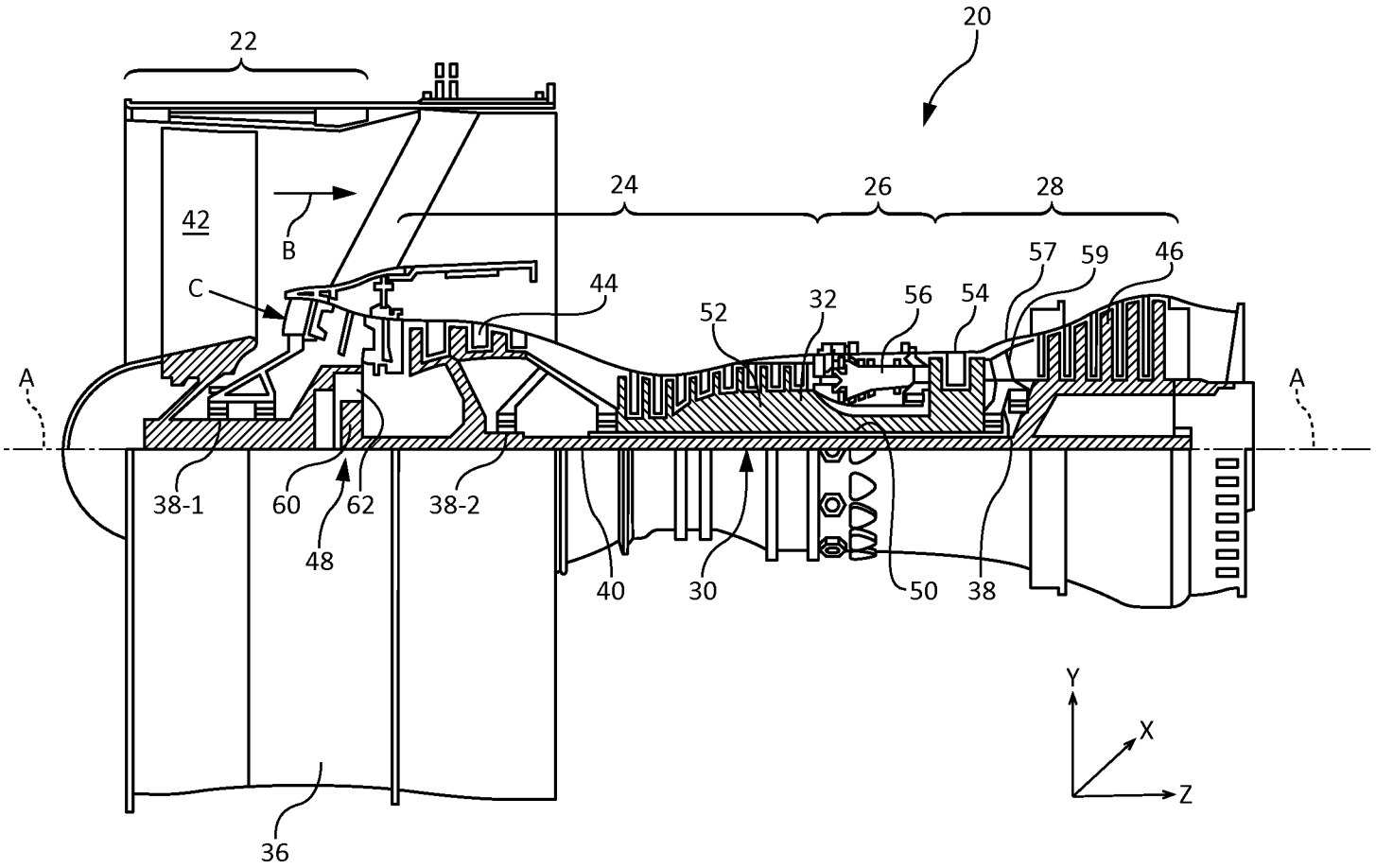
FIG. 1 illustrates an exemplary gas turbine engine, in accordance with various embodiments.

In various embodiments and with reference to FIG. 1, a gas turbine engine 20 is provided. Gas turbine engine 20 may be a two-spool turbofan that generally incorporates a fan section 22, a compressor section 24, a combustor section 26 and a turbine section 28. Alternative engines may include, for example, an augmentor section among other systems or features. In operation, fan section 22 can drive coolant (e.g., air) along a bypass flow-path B while compressor section 24 can drive coolant along a core flow-path C for compression and communication into combustor section 26 then expansion through turbine section 28. Although depicted as a turbofan gas turbine engine 20 herein, it should be understood that the concepts described herein are not limited to use with turbofans as the teachings may be applied to other types of turbine engines including three-spool architectures.

Gas turbine engine 20 may generally comprise a low speed spool 30 and a high speed spool 32 mounted for rotation about an engine central longitudinal axis A-A' relative to an engine static structure 36 via several bearing systems 38, 38-1, and 38-2. It should be understood that various bearing systems 38 at various locations may alternatively or additionally be provided, including for example, bearing system 38, bearing system 38-1, and bearing system 38-2.

Low speed spool 30 may generally comprise an inner shaft 40 that interconnects a fan 42, a low-pressure compressor 44 and a low-pressure turbine 46. Inner shaft 40 may be connected to fan 42 through a geared architecture 48 that can drive fan 42 at a lower speed than low speed spool 30. Geared architecture 48 may comprise a gear assembly 60 enclosed within a gear housing 62. Gear assembly 60 couples inner shaft 40 to a rotating fan structure. High speed spool 32 may comprise an outer shaft 50 that interconnects a high-pressure compressor 52 and high-pressure turbine 54. A combustor 56 may be located between high-pressure compressor 52 and high-pressure turbine 54. Mid-turbine frame 57 may support one or more bearing systems 38 in turbine section 28. Inner shaft 40 and outer shaft 50 may be concentric and rotate via bearing systems 38 about the engine central longitudinal axis A-A', which is collinear with their longitudinal axes. As used herein, a "high-pressure" compressor or turbine experiences a higher pressure than a corresponding "low-pressure" compressor or turbine.

The core airflow C may be compressed by low-pressure compressor 44 then high-pressure compressor 52, mixed and burned with fuel in combustor 56, then expanded over high-pressure turbine 54 and low-pressure turbine 46. Mid-turbine frame 57 includes airfoils 59, which are in the core airflow path. Airfoils 59 may be formed integrally into a full-ring, mid-turbine-frame stator and retained by a retention pin. Turbines 46, 54 rotationally drive the respective low speed spool 30 and high speed spool 32 in response to the expansion.

Gas turbine engine 20 may be, for example, a high-bypass ratio geared aircraft engine. In various embodiments, the bypass ratio of gas turbine engine 20 may be greater than about six (6). In various embodiments, the bypass ratio of gas turbine engine 20 may be greater than ten (10). In various embodiments, geared architecture 48 may be an epicyclic gear train, such as a star gear system (sun gear in meshing engagement with a plurality of star gears supported by a carrier and in meshing engagement with a ring gear) or other gear system. Geared architecture 48 may have a gear reduction ratio of greater than about 2.3 and low-pressure turbine 46 may have a pressure ratio that is greater than about five (5). In various embodiments, the bypass ratio of gas turbine engine 20 is greater than about ten (10:1). In various embodiments, the diameter of fan 42 may be significantly larger than that of the low-pressure compressor 44. Low-pressure turbine 46 pressure ratio may be measured prior to inlet of low-pressure turbine 46 as related to the pressure at the outlet of low-pressure turbine 46 prior to an exhaust nozzle. It should be understood, however, that the above parameters are exemplary of various embodiments of a suitable geared architecture engine and that the present disclosure contemplates other turbine engines including direct drive turbofans.

Combustor 56 may include both radial and axial fuel delivery systems, as discussed in further detail below. The radial fuel delivery systems may be angled relative to the axial gas flow through combustor 56. Angling the radial duel delivery systems of combustor 56 may impact the completeness of the fuel burn and thus emissions. Angling the radial fuel delivery system may also impact the length of ignited gasses ejected from the radial fuel delivery system.

Figure 2:
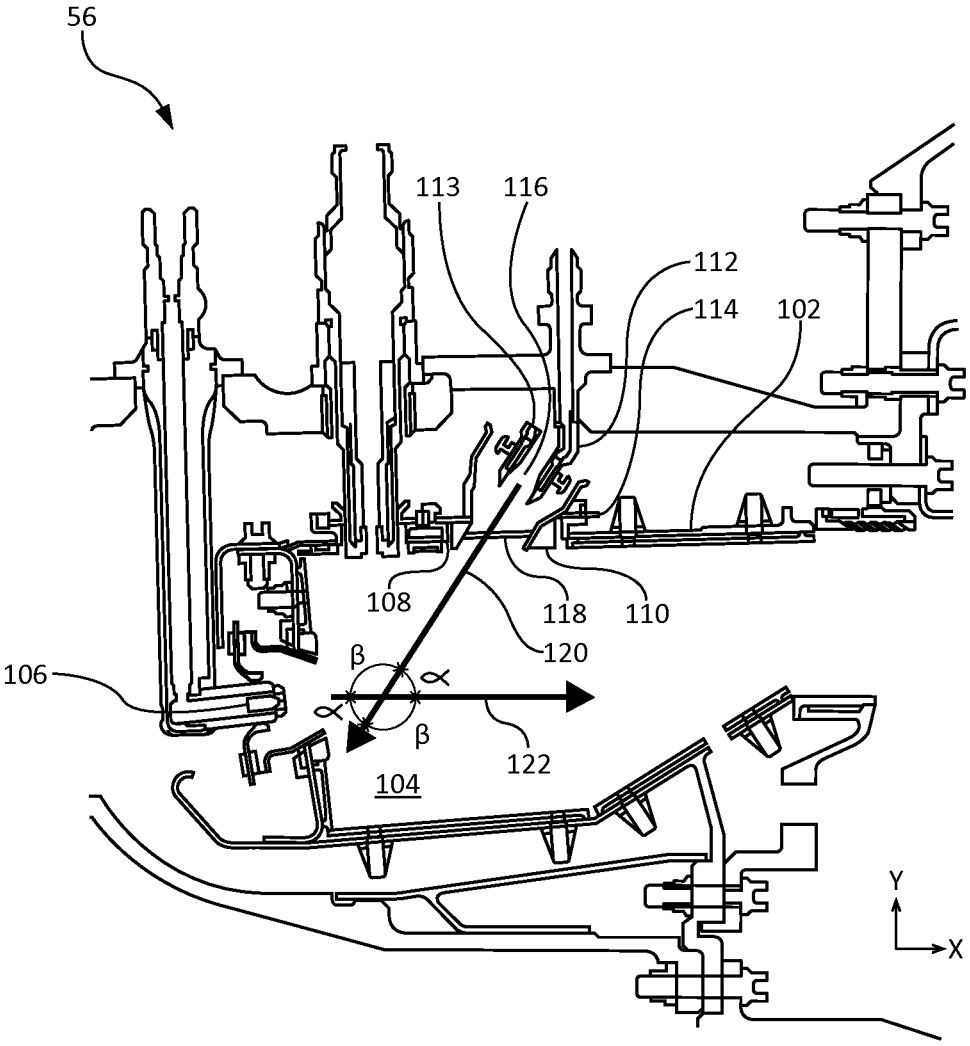
FIG. 2 illustrates a combustor of a gas turbine engine including a radial main mixer at an angle relative to the combustor and gas flow, in accordance with various embodiments.

With reference to FIG. 2, a combustor 56 having an axial fuel delivery system 106 at a forward location of the combustor and a radial fuel delivery system 112 aft of axial fuel delivery system 106 according to various embodiments. A xy axis is provided for ease of description. Radial fuel delivery system 112 delivers fuel into combustion chamber 104 in an at least partially radial direction (i.e., the y direction). Radial fuel delivery system 112 has nozzle 113 in cavity 116 defined by bluff body 118 and mixer 110. Mixer 110 mixes the fuel delivered by radial fuel delivery system 112 with air and provides a stable burn pattern. Mixer 110 comprises a bluff body 118 extending from inner walls of mixer 110, as described in further detail below. Mixer 110 may rest in opening 108 defined by combustor liner 102. Mixer 110 may be secured to combustor 56 by tabs 114.

In various embodiments, radial fuel delivery system 112 may deliver fuel into combustor 56 in direction 120. Fuel delivery direction 120 is the direction that fuel is traveling when leaving nozzle 113 and/or mixer 110. Fuel delivery direction 120 may have a radial component (i.e., in the y direction) and an axial component (i.e., in the x direction). Gas flow direction 122 is the direction of compressed gas in core flowpath C (of FIG. 1) entering combustor 56. Fuel delivered by axial fuel delivery system 106 may also move in gas flow direction 122.

In various embodiments, fuel delivery direction 120 may be selected relative to a gas flow direction 122. The angle between the gas flow direction 122 and fuel delivery direction 120 may be described as negative, neutral, or positive. Radial fuel delivery system 112 is at a "negative angle" when gas flow direction 122 and fuel delivery direction 120 are oriented with angle $\alpha$ being acute (i.e., less than 90°) and angle $\beta$ being obtuse (i.e., greater than 90°). In that regard, radial fuel delivery system 112 at a negative angle directs a fuel/air mixture at least partially upstream or in a direction opposite gas flow direction 122. Radial fuel delivery system 112 is at a "positive angle" when gas flow direction 122 and fuel delivery direction 120 are oriented with angle $\alpha$ being obtuse (i.e., greater than 90°) and angle $\beta$ being acute (i.e., less than 90°). Radial fuel delivery system 112 is at a "neutral angle" when both angles $\alpha$ and $\beta$ are approximately 90°.

In various embodiments, a radial fuel delivery system 112 oriented so that fuel delivery direction 120 is oriented relative to gas flow direction 122 with angle $\alpha$ being between 5° and 85° or between 15° and 75°. Orienting radial fuel delivery system 112 at a negative angle (e.g., with angle $\alpha$ between 5° and 85°) tends to provide shortened flame length and improved burn completion relative to radial fuel delivery system 112 oriented at positive and/or neutral angles, as described in further detail below.

Figure 3A:
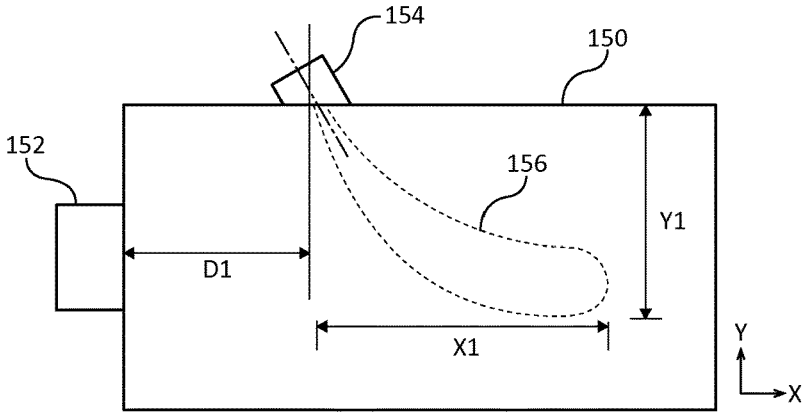
FIG. 3A illustrates a combustor with a radial main mixer angled in a direction of gas flow, in accordance with various embodiments.

With reference to FIG. 3A, a combustor 150 is shown with axial fuel delivery system 152 oriented at a positive angle, in accordance with various embodiments. Radial fuel delivery system 154 may be aft of axial fuel delivery system 152 and separated from axial fuel delivery system 152 by a distance $D_1$. Gas in combustor 150 may flow generally in an aft direction (i.e., a direction along the x axis). Radial fuel delivery system may deliver fuel into combustor 150 at an angle relative to gas flow direction defined by the x axis. Radial fuel delivery system 154 may also deliver fuel at an angle relative to a radial direction (i.e., a direction along the y axis). Axial fuel delivery system 152 oriented at a positive angle may produce flame 156 with large $X_1$ (width) and $Y_1$ (height) dimensions relative to an axial fuel delivery system oriented at a negative angle, as described in further detail below.

Figure 3B:
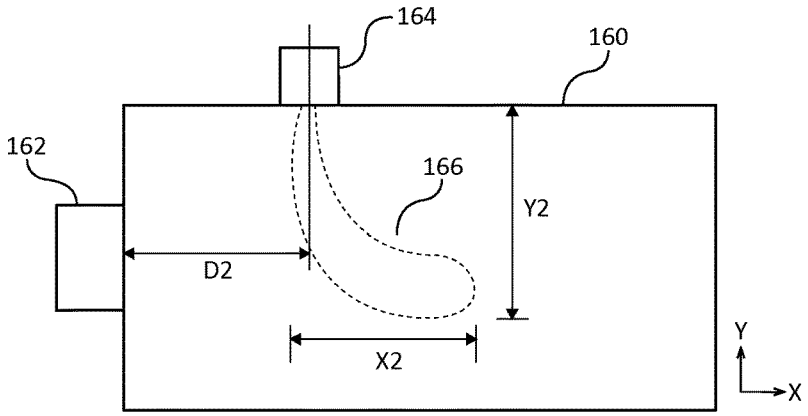
FIG. 3B illustrates a combustor with a radial main mixer angled perpendicular to a direction of gas flow, in accordance with various embodiments.

With reference to FIG. 3B, a combustor 160 is shown with axial fuel delivery system 162 oriented at a neutral angle (i.e., a right angle), in accordance with various embodiments. Radial fuel delivery system 164 may be aft of axial fuel delivery system 162 and separated from axial fuel delivery system 162 by a distance $D_2$. Gas in combustor 160 may flow generally in an aft direction (i.e., a direction along the x axis). Radial fuel delivery system may deliver fuel into combustor 160 perpendicular to gas flow direction defined by the x axis. Radial fuel delivery system 164 may also deliver fuel perpendicular to a radial direction (i.e., a direction along the y axis). Axial fuel delivery system 162 oriented at a positive angle may produce flame 166 with large $X_2$ (width) and $Y_2$ (height) dimensions relative to an axial fuel delivery system oriented at a negative angle, as described in further detail below.

Figure 3C:
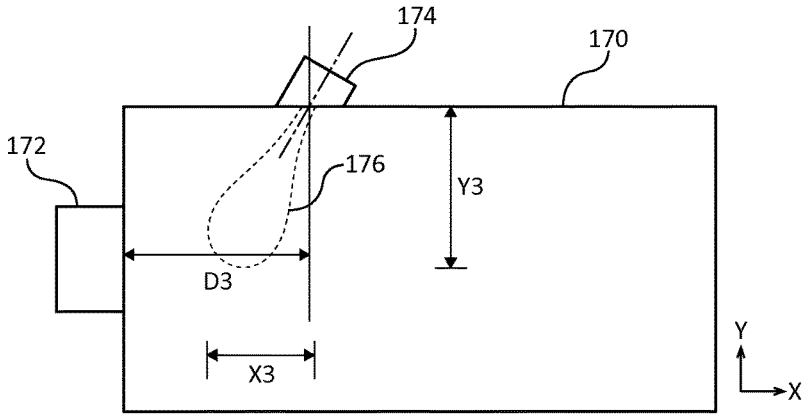
FIG. 3C illustrates a combustor with a radial main mixer angled in a negative direction, in accordance with various embodiments.

With reference to FIG. 3C, a combustor 170 is shown with axial fuel delivery system 172 oriented at a negative angle, in accordance with various embodiments. Radial fuel delivery system 174 may be aft of axial fuel delivery system 172 and separated from axial fuel delivery system 172 by a distance $D_1$. Gas in combustor 170 may flow generally in an aft direction (i.e., a direction along the x axis). Radial fuel delivery system 172 may deliver fuel into combustor 170 at an angle relative to the direction of the gas flow in combustor 170 defined by the x axis as depicted. In that regard, radial fuel delivery system 172 may delivery a fuel mixture in at least a partially upstream direction relative to the flow of gas in combustor 170 (i.e., moving at least partially forward towards axial fuel delivery system 172 as depicted). Radial fuel delivery system 174 may also deliver fuel at an angle relative to a radial direction (i.e., a direction along the y axis). Axial fuel delivery system 172 oriented at a positive angle may produce flame 176 with small $X_1$ (width) and $Y_1$ (height) dimensions relative to an axial fuel delivery system oriented at a positive or neutral angle, as described above.

Figure 4:
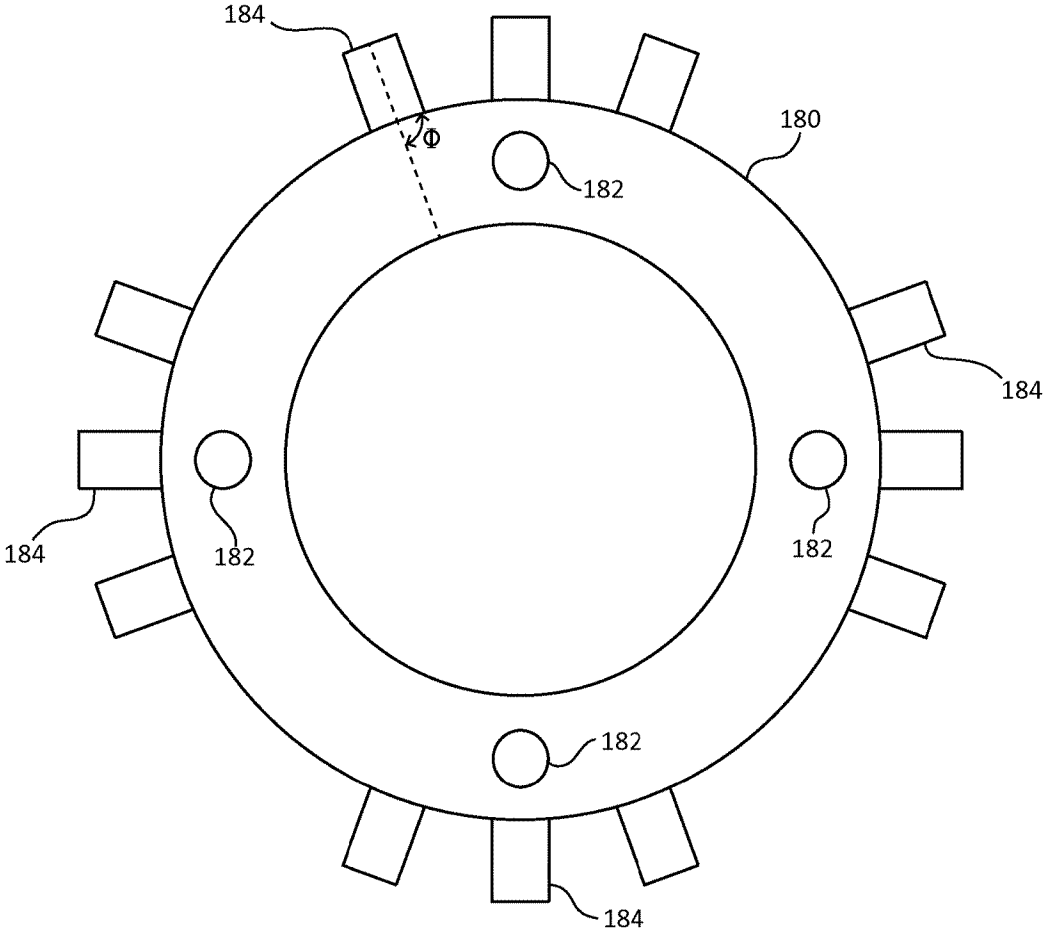
FIG. 4 illustrates an annular combustor with an axial fuel delivery system circumferentially distributed about the combustor, in accordance with various embodiments.

With reference to FIG. 4, an annular combustor 180 is shown as viewed from forward to aft with axial fuel delivery systems 182 and radial fuel delivery systems 184. Annular combustor 180 may have multiple radial fuel delivery systems 184 for each axial fuel delivery system 182. Axial fuel delivery systems 182 may serve as pilot lights. The combustion supported by axial fuel delivery system 182 may ignite fuel mixture exiting radial fuel delivery system 184. In various embodiments, annular combustor 180 may include one or more radial fuel delivery systems 184 for each axial fuel delivery system 182 (e.g., one to three radial fuel delivery systems 184 for each axial fuel delivery system 182). Each radial fuel delivery system 184 may be oriented at radial angle $\phi$ relative to a radial direction. Radial fuel delivery system 184 may be oriented at a negative axial angle $\alpha$ (as shown in FIG. 2) with a radial angle $\phi$ (in a circumferential direction) between −90° and 90°. Radial fuel delivery system 184 oriented at a negative axial angle $\alpha$ may tend to provide improved fuel burn and a short flame length for any radial angle $\phi$.

Benefits and other advantages have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, and any elements that may cause any benefit or advantage to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. An annular combustor, comprising:

a combustor liner defining a combustion chamber;

an axial fuel delivery system located forward the combustion chamber, wherein the axial fuel delivery system delivers a first fuel into the combustion chamber in a gas flow direction, wherein the gas flow direction is a direction of compressed gas traveling axially through the combustion chamber; and a radial fuel delivery system aft of the axial fuel delivery system, the radial fuel delivery system comprising:

a mixer comprising a bluff body, wherein a mouth of the mixer is coupled to an opening in the combustor liner, and wherein the bluff body extends from an inner wall of the mixer and spans the mouth of the mixer, and a nozzle in a cavity defined by the bluff body and the mixer, wherein the nozzle delivers a second fuel into the cavity to form a mixture of the second fuel and air in the cavity, and wherein the nozzle is oriented at an angle of between 5 degrees and 85 degrees relative to the gas flow direction and directs the second fuel into the combustion chamber at least partially in an upstream direction relative to the gas flow direction, and wherein the first fuel and the second fuel are ignited in the combustion chamber, wherein the radial fuel delivery system extends at least partially though the combustor liner, and wherein the radial fuel delivery system is configured to direct the mixture of the second fuel and air over the bluff body to increase a mixing of the second fuel and air upon entering the combustion chamber.

2. The annular combustor of claim 1, wherein the radial fuel delivery system is configured to direct the mixture of the second fuel and air into the combustion chamber at an axial angle between 5 degrees and 85 degrees relative to the combustor liner.

3. The annular combustor of claim 1, wherein the radial fuel delivery system is configured to direct the mixture of the second fuel and air into the combustion chamber at an axial angle between 15 degrees and 75 degrees relative to the combustor liner.

4. The annular combustor of claim 1, further comprising a plurality of axial fuel delivery systems having between one and three radial fuel delivery systems for each axial fuel delivery system.

5. A gas turbine engine, comprising:

a compressor;

an annular combustor aft of the compressor, the annular combustor comprising a combustor liner disposed radially outward of a combustion chamber;

an axial fuel delivery system located forward the combustion chamber, wherein the axial fuel delivery system delivers a first fuel into the combustion chamber in a gas flow direction, and wherein the gas flow direction is a direction of compressed gas traveling axially through the annular combustor; and a radial fuel delivery system downstream of the axial fuel delivery system, the radial fuel delivery system comprising:

a mixer comprising a bluff body, wherein a mouth of the mixer is coupled to an opening in the combustor liner, and wherein the bluff body spans the mouth of the mixer, and a nozzle in a cavity defined by the mixer, wherein the nozzle delivers a second fuel into the cavity, and wherein the nozzle is oriented at an angle of between 5 degrees and 85 degrees relative to the gas flow direction, and wherein the radial fuel delivery system is configured to direct the second fuel into the combustion chamber at least partially in an upstream direction, and wherein the first fuel and the second fuel are ignited in the combustion chamber, wherein the radial fuel delivery system extends at least partially through the combustor liner, and wherein the radial fuel delivery system is configured to direct a mixture of the second fuel and air over the bluff body to increase a mixing of the second fuel and air upon entering the combustion chamber.

6. The gas turbine engine of claim 5, wherein the radial fuel delivery system is configured to direct the second fuel into the combustion chamber at an angle between 5 degrees and 85 degrees relative to the combustor liner.

7. The gas turbine engine of claim 5, wherein the radial fuel delivery system is configured to direct the second fuel into the combustion chamber at an angle between 15 degrees and 75 degrees relative to the combustor liner.

8. The gas turbine engine of claim 5, wherein the annular combustor further comprises a plurality of axial fuel delivery systems having at least one to three radial fuel delivery systems for each axial fuel delivery system.

9. A radial fuel delivery system, comprising:

an annular combustor comprising a combustor liner defining a combustion chamber;

a mixer coupled to the combustor liner, the mixer comprising a bluff body, wherein a mouth of the mixer is located in an opening in the combustor liner, and wherein the bluff body extends from an inner wall of the mixer and spans the mouth of the mixer; and a nozzle disposed within a cavity defined by the mixer, wherein the mixer and the nozzle are configured to direct fuel into the combustion chamber at least partially in an upstream direction relative to an axial gas flow through the combustion chamber, wherein the fuel is ignited in the combustion chamber, and wherein at least one of the nozzle or the inner wall of the mixer is oriented at an angle of between 5 degrees and 85 degrees relative to the combustor liner, wherein the mixer and the nozzle are configured to direct a mixture of the fuel and air over the bluff body to increase a mixing of the fuel and air upon entering the combustion chamber.

10. The radial fuel delivery system of claim 9, wherein the mixer and the nozzle are configured to deliver the mixture of the fuel and air into the combustion chamber at a negative angle relative to the axial gas flow through the combustion chamber.

11. The radial fuel delivery system of claim 9, wherein the radial fuel delivery system is configured to direct the mixture of the fuel and air into the combustion chamber at an angle between 5 degrees and 85 degrees relative to the axial gas flow through the combustion chamber.

12. The radial fuel delivery system of claim 9, wherein the radial fuel delivery system is configured to direct the mixture of the fuel and air into the combustion chamber at an angle between 15 degrees and 75 degrees relative to the axial gas flow through the combustion chamber.

13. The radial fuel delivery system of claim 9, wherein the mixer is disposed at least partially through the combustor liner.

14. The radial fuel delivery system of claim 9, wherein the nozzle is oriented at an acute angle relative to the combustor liner.

* * * * *